US007578055B2

(12) United States Patent
Rapp

(10) Patent No.: US 7,578,055 B2
(45) Date of Patent: Aug. 25, 2009

(54) TOOL FOR THE MECHANICAL CONNECTION OF PLATES

(76) Inventor: Eugen Rapp, Max-Reger-Strasse 4, Berg (DE) 88276

( * ) Notice: Subject to any disclaimer, the term of this patent is extended or adjusted under 35 U.S.C. 154(b) by 0 days.

(21) Appl. No.: 10/477,335

(22) PCT Filed: May 13, 2002

(86) PCT No.: PCT/DE02/01711

§ 371 (c)(1),
(2), (4) Date: Dec. 15, 2003

(87) PCT Pub. No.: WO02/092256

PCT Pub. Date: Nov. 21, 2002

(65) Prior Publication Data

US 2004/0143948 A1 Jul. 29, 2004

(30) Foreign Application Priority Data

May 11, 2001 (DE) ..... 101 23 007

(51) Int. Cl.
*B23P 19/00* (2006.01)
*B21D 37/14* (2006.01)

(52) U.S. Cl. ..... 29/798; 29/521; 29/243.5; 29/283.5; 72/470; 72/481.1; 72/482.93

(58) Field of Classification Search ..... 29/505, 29/509, 432, 432.1, 432.2, 521, 525, 798, 29/243.5, 283.5; 72/464, 470, 473, 481.1, 72/482.93, 482.94
See application file for complete search history.

(56) References Cited

U.S. PATENT DOCUMENTS 3,771,216 A * 11/1973 Johnson ..... 29/509

(Continued)

FOREIGN PATENT DOCUMENTS

DE 3726392 A1 * 2/1989

(Continued)

OTHER PUBLICATIONS

Japanese Patent Abstract P2000-277668, Oct. 6, 2000.

*Primary Examiner*—Jermie E Cozart

(57) ABSTRACT

The tool, for bonding two plates together, has a punch (1) and a die (2) each as two-part structures with a positive fit between the two parts. One part (8, 13), as a tool which acts directly on the plate workpieces (3), is of a harder material than the other part (7, 12) which acts as a tool holder. The punch and die are divided into their two parts across the working direction.

16 Claims, 1 Drawing Sheet

U.S. PATENT DOCUMENTS

| | | | | | |
|---|---|---|---|---|---|
| 3,900,937 | A | * | 8/1975 | Schleicher | 29/566.1 |
| 4,208,776 | A | * | 6/1980 | Schleicher | 29/243.5 |
| 4,306,511 | A | * | 12/1981 | Ashby et al. | 29/521 |
| RE31,535 | E | * | 3/1984 | Schleicher | 29/432.2 |
| 4,459,735 | A | * | 7/1984 | Sawdon | 29/509 |
| 4,660,403 | A | * | 4/1987 | Slasinski | 72/389.1 |
| 4,803,767 | A | * | 2/1989 | Obrecht et al. | 29/243.5 |
| 4,825,525 | A | * | 5/1989 | Obrecht et al. | 29/243.5 |
| 4,831,711 | A | | 5/1989 | Rapp | |
| 5,155,897 | A | * | 10/1992 | Schleicher | 29/509 |
| 5,177,861 | A | | 1/1993 | Sawdon | |
| 5,259,102 | A | * | 11/1993 | Obrecht | 29/243.519 |
| 5,490,310 | A | * | 2/1996 | Schleicher | 29/243.5 |
| 5,528,815 | A | * | 6/1996 | Webb | 29/509 |
| 5,621,961 | A | * | 4/1997 | Schleicher | 29/509 |
| 5,884,386 | A | | 3/1999 | Blacket et al. | |
| 6,199,451 | B1 | * | 3/2001 | Sollami | 76/108.2 |

FOREIGN PATENT DOCUMENTS

| | | | | |
|---|---|---|---|---|
| DE | 19700627 | | | 7/1997 |
| DE | 19913695 | | | 1/2000 |
| DE | 19752201 | | | 7/2001 |
| DE | 10006789 | | | 8/2001 |
| EP | 0215449 | | | 8/1988 |
| EP | 653255 | A1 | * | 5/1995 |
| JP | 56114536 | A | * | 9/1981 |
| JP | 57195541 | A | * | 12/1982 |
| JP | 57195542 | A | * | 12/1982 |
| JP | 04017927 | A | * | 1/1992 |

* cited by examiner 6
18
7
21
19
II
II
9
8
10
20
4
3
3
16
17
15
5
13
14
1
2
20
12
19
21
6
18

11
8
I
I
10
7

TOOL FOR THE MECHANICAL CONNECTION OF PLATES

FIELD OF THE INVENTION

The invention relates to tools for the mechanical processing of plates, for their joining with one another (clinch joining), pressing, stamping or the like with a punch and a die.

BACKGROUND OF THE INVENTION

In the case of usual tools of the generic type (see, for example German patent specification 3710929 and its equivalent U.S. Pat. No. 4,831,711) used for clinch joining, the punch has a pin with a smaller diameter, by means of which the plates to be joined are deep drawn and squashed in a blind hole to achieve a firm joint between the plates. Other generic methods are also known, whereby tools, comprising a punch and die, are used for pressing, stamping or the like of plates, also, inter alia, for joining parts on the plates (German published patent application 19913695).

In the case of a joining it is also known to strongly cool the tools on the side of the punch and/or of the die, i.e. the punch and the die, thus enabling the joining of plates partly made from polymers or contain polymers with one another (German published patent application 19752201). By virtue of this it will be achieved that when plates made of visco-elastic materials, like polymers, rubber, etc. are processed with other materials, like for example metal, similar physical prerequisites will be present making such a joining possible. Such composite tools are, of course, expensive and are used only when the application or the necessity is appropriate.

In the case of another known method of the generic type (German published patent application 10006789) special attention is given regarding the mounting of the tool, i.e. of the punch or the die, in the tool holder of the machine, the aim being a favourable exchange of these tools, for the purpose of which an appropriate radial displaceability is provided.

Basically, but also in all of these cases, the sections of the tool directly affected by the work process, are particularly stressed, The tool life of the tools used on this occasion corresponds to the use and requirements of the material of the tool and in many cases is unsatisfactorily short. To achieve the accepted standard, the expense connected with the manufacture of the tools is very high, since they have to have an appropriate hardness in the stressed region. On the other hand such hardness may lead to a breakage of the tool, especially when an often required considerable longitudinal extension at right angle to the working direction is present. In addition, due to the mounting a minimum longitudinal extension in the working direction is necessary; this means that due to these conditions the punch and the die, having a hardness necessary for a long tool life, have a certain tendency to break, while such a breakage can have disastrous consequences. Particularly when the tool is used in the serial production for the joining of sheet metals for motor vehicles has such a shortcoming disastrous consequences. Thus the aim is always a tool with an optimum tool life with extremely favourable hardness and only slight tendency to break.

SUMMARY OF THE INVENTION

In contrast to the above, the tool according to the invention with the characterising features of the main claim has the advantage that only that part which is actually necessary for the process, namely the insert has the necessary hardness and due to its construction is subjected to smaller break loads or to none at all, whereas the other portion, namely the mounting part, can be made from a softer and more elastic material appropriate to its purpose. Despite the division into two of both the punch and/or of the die, the manufacturing expense of the tool, particularly when considering the above described risks, is more favourable as in the case of the comparable state-of-the-art. In addition, the cross-sections of the punch and/or of the die transferring the working forces are greater than the cross-sections subjected to the actual processing of the plates, so that in the case of the invention to transfer the force the cross-sections of the elastic material are advantageously greater and smaller cross-sections, with appropriate hardness of the tool, are used for the actual processing of the plates.

Depending from the type of the tool, the invention may be used either for the punch or for the die, or for both.

According to an advantageous development of the invention the punch and/or the die are constructed divided perpendicularly to the driving direction (working direction), so that to achieve in this manner an adequate form-locking and a force-locking resulting from it. In this conjunction it is not a problem to construct the surfaces of the insert and of the mounting part that oppose one another in the working direction so large, that no overload, especially on the surface of the mounting part, will occur.

According to an additional advantageous development of the invention in the face of the mounting part, facing the insert, there is a recess for the form-locking connection with the insert. In the case of this recess one usually deals here with a bore or the like, into which the corresponding insert, with its end facing it, can be pressed or inserted. On this occasion the edges of the insert can be chamfered or radiused to achieve a simpler introduction.

According to a relevant advantageous development of the invention the form locking connection between the insert and the mounting part is constructed as a press connection, i.e. there is a radial pressure between the inner wall of the recess and the jacket surface of the insert.

According to an additional advantageous development of the invention the insert has a plug-like construction and after its insertion into the recess forms its bottom. This development of the invention concerns foremost the die, where the insert does not protrude from the recess, since it should merely form the bottom due to the extraordinarily high stress existing there.

According to an additional advantageous development of the invention the connection between the mounting part and the insert has a relative rotation preventing construction. This rotational lock can be achieved simply by flattening the circular cross-section used for the mounting.

According to a special advantageous development of the invention the lateral walls of the recess are at a radial distance from the jacket surface of the punch, while the recess is constructed in the radial and axial directions as a blind opening, the lateral walls of which extend in the direction of movement of the punch, and just like the bottom of the recess, are constructed inflexibly. Such a construction and coordination of the punch and the die is, per se, known (EP 0215449), although with the disadvantages of the state-of-the-art mentioned in the introduction. By using the invention a considerable progress is being made, since it is known that during deep drawing and the subsequent squashing of portions of the plate the load in the working direction is extraordinarily high, while in contrast to this the resisting radial forces may be considerably lower.

According to another special development of the invention the tool is used for the joining of components, namely bolts, nuts or the like with a plate, whereby a lost punch is in front of the tool punch, the lost punch remaining on the plate after the process (German published patent application 19913695).

Further advantages and advantageous developments of the invention become apparent from the following description, drawing and claims.

BRIEF DESCRIPTION OF THE DRAWINGS

An embodiment of the subject matter of the invention is illustrated in the drawing and is described in detail below. They show in.

DETAILED DESCRIPTION OF THE INVENTION

Figure 1:
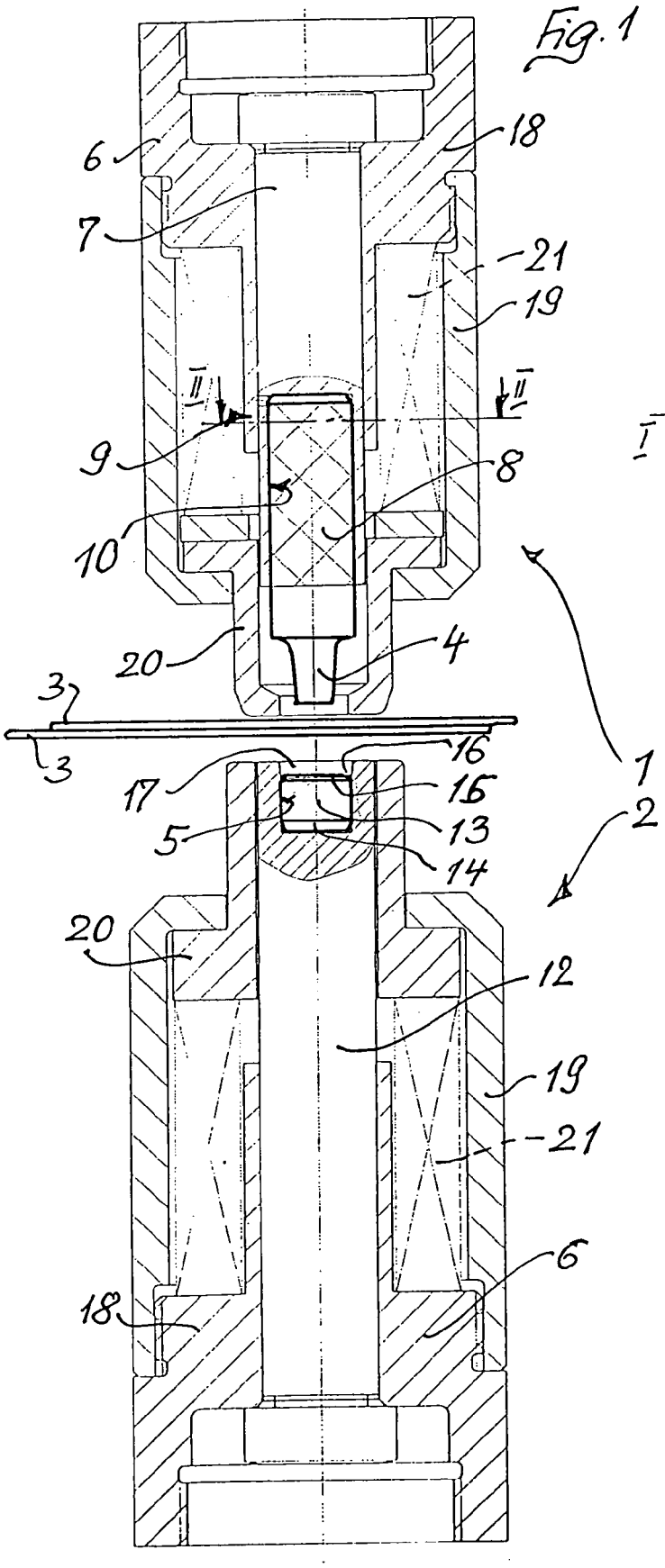
FIG. 1—a partial longitudinal section through the punch, die and tool holder in an exploded illustration, partly corresponding to line I-I of FIG. 2, and FIG. 2—a cross-section corresponding to line II-II of FIG. 1.
Figure 2:
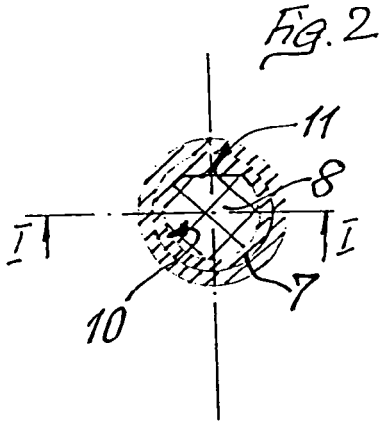

The drawing shows the tool according to the invention with the tool holders in an exploded illustration, but without their mounting in the machine itself, wherein two sheet metals 3, to be joined with one another, are provided between a punch 1 and a die 2. To join the sheet metals with one another, the punch 1 is moved downwards and pulls with a pin 4 provided on its end the correspondingly affected sections of the sheet metals 3 into a recess 5 of the die 2, and also to radially squash these deep drawn sheet metal sections during the continuation of the stroke, so that a mutual engagement of the deep drawn and squashed sections of the plates takes place, resulting in a firm connection between the plates 3 by virtue of this clinch joining.

The punch 1 is arranged in the machine (not illustrated) by means of a tool holder 6 and it is made up from two parts, namely a mounting part 7 and an insert 8 having a pin 4. Due to the higher load the insert 8 with the pin 4 is considerably harder than the mounting part 7 and the tool holder 6 that is under smaller stress also due to its larger cross-section. The mounting part 7 and the insert 8 are joined with one another by means of a press connection 9, while the upper end of the insert 8 is pressed into a recess 10 of the mounting part 7 in a form-locking manner and is capable of accepting great forces. A flat 11 on the end section of the insert 8 protruding into the recess 10 serves for the purpose of preventing a rotation between the insert 8 and the mounting part 7.

The die 2, that is also arranged in a tool holder 6, has also a two-part construction, comprising a mounting part 12 with a recess 5 and a plug 13 pressed into the recess 5, that for a better insertion into the recess 5 has a bevel 14 on its underside. A bevel 15 may also be provided on its upper side, so that finally a bead 16, advantageous for the manufacture, will result. The remainder of the recess 5 serves, in the usual manner, as the deep draw opening 17 of the die 2. Thus the bottom of this deep draw opening 17 is formed by the plug 13, the material of which is also considerably harder than the mounting part 12 of this die.

The tool holder 6 has a base part 18 that is connected with the machine, into which base part the punch 1 or the die 2 are inserted, and are held in their working position by means of clamping nuts 19 and spring washers 20, as well as springs 21.

All features, illustrated in the description, the following claims and the drawing can be significant for the invention both individually and in any combination with one another.

The invention claimed is:

1. A tool for the mechanical processing of plates, for joining with one another via pressing and/or stamping with a punch and a die, said tool having a first part on one side of at least one plate, and a second part on an opposite side of said plate, comprising:

a first tool holder and a second tool holder, a male punch and a female die, at least one of the punch and the die having a punch insert and/or a die insert respectively for contacting and processing the plates, and a respective mounting part which receives the insert, a form-locking connection between the insert and the mounting part, the insert being of a harder material than its mounting part and being substantially immovable with respect to its mounting part, the punch and the die being separated with respect to an axial driving direction, wherein in a face of a mounting part facing the insert, there is a recess for the form-locking connection with the insert.

2. A tool according to claim 1, wherein the form-locking connection between the insert and the mounting part is constructed as a press connection.

3. A tool according to claim 2, wherein the form-locking connection between the insert and the mounting part is constructed as a press connection.

4. A tool according to claim 3 wherein the insert has a plug shape and after its insertion into the recess forms the bottom of the recess.

5. A tool according to claim 3 wherein the connection between the mounting part and the insert prevents relative rotation.

6. A tool according to claim 2 wherein the insert has a plug shape and after its insertion into the recess forms the bottom of the recess.

7. A tool according to claim 2 wherein the connection between the mounting part and the insert prevents relative rotation.

8. A tool according to claim 1 wherein the insert has a plug shape and after its insertion into the recess forms the bottom of the recess.

9. A tool according to claim 8 wherein the connection between the mounting part and the insert prevents relative rotation.

10. A tool according to claim 1 wherein the connection between the mounting part and the insert prevents relative rotation.

11. A tool according to claim 1 wherein the lateral walls of the recess are at a radial distance from a jacket surface of a forming punch, and the recess in the die is constructed as a blind opening, the lateral walls of the recess are arranged axially in the direction of axial movement of the punch, a bottom portion being arranged transverse to the lateral walls, the bottom and the lateral walls of the recess are substantially inflexible.

12. A tool according to claim 1, comprising joining components to the plate, and the punch that can be pressed into the plate, the punch driven by a tool punch.

13. A tool according to claim 1 wherein the insert has a plug shape and after its insertion into the recess forms the bottom of the recess.

14. A tool according to claim 1 wherein the connection between the mounting part and the insert prevents relative rotation.

15. A tool according to claim 1 wherein the connection between the mounting part and the insert prevents relative rotation.

16. A tool according to claim 1 wherein the lateral walls of a recess are at a radial distance from a jacket surface of a forming punch, and the recess in the die is constructed in the radial and axial directions as a blind opening, the lateral walls of the recess are arranged axially in the direction of axial movement of the punch, a bottom portion being arranged transverse to the lateral walls, the bottom and the lateral walls of the recess being substantially inflexible, a recess for the form-locking connection with the insert disposed in a face of the mounting part facing the insert, the form-locking connection between the insert and the mounting part being constructed as a press connection, the insert having a plug shape and after its insertion into the recess forms the bottom of the recess, wherein the connection between the mounting part and the insert prevents relative rotation.

* * * * *